United States Patent [19]

Davis

[11] 4,310,267

[45] Jan. 12, 1982

[54] SAFETY TRENCH BOX

[76] Inventor: Clinton Davis, Rte. 1, Box 246 B, Corning, Calif. 96021

[21] Appl. No.: 130,087

[22] Filed: Mar. 13, 1980

[51] Int. Cl.[3] ..... E21D 5/00

[52] U.S. Cl. ..... 405/283; 405/284

[58] Field of Search ..... 405/282–285

[56] References Cited

U.S. PATENT DOCUMENTS

| | | | |
|---|---|---|---|
| 2,633,713 | 4/1953 | Shields | 405/283 |
| 2,865,178 | 12/1958 | Wicke | 405/283 |
| 3,473,336 | 10/1969 | Torti | 405/283 |
| 3,922,866 | 12/1975 | Benning | 405/283 |
| 4,058,983 | 11/1977 | Griswold | 405/283 |

*Primary Examiner*—Ernest R. Purser

*Attorney, Agent, or Firm*—Blair, Brown & Kreten

[57] ABSTRACT

Disclosed herein is a safety trench box for use in protecting workmen from cave-ins while operating within an excavated area. The device includes a barrier which surrounds the work area having a depth substantially that of the trench and an opening along one wall of the barrier that allows work to be sequentially fed therethrough. The safety device includes a pair of runners upon which the device is carried so that advancing the safety device can be easily accomplished.

8 Claims, 8 Drawing Figures

10
1
2
3
4
5
6
7
8
11
12
15

1
3
4
P
7
8
10
11
12

2
7
11
12

FIG. 4
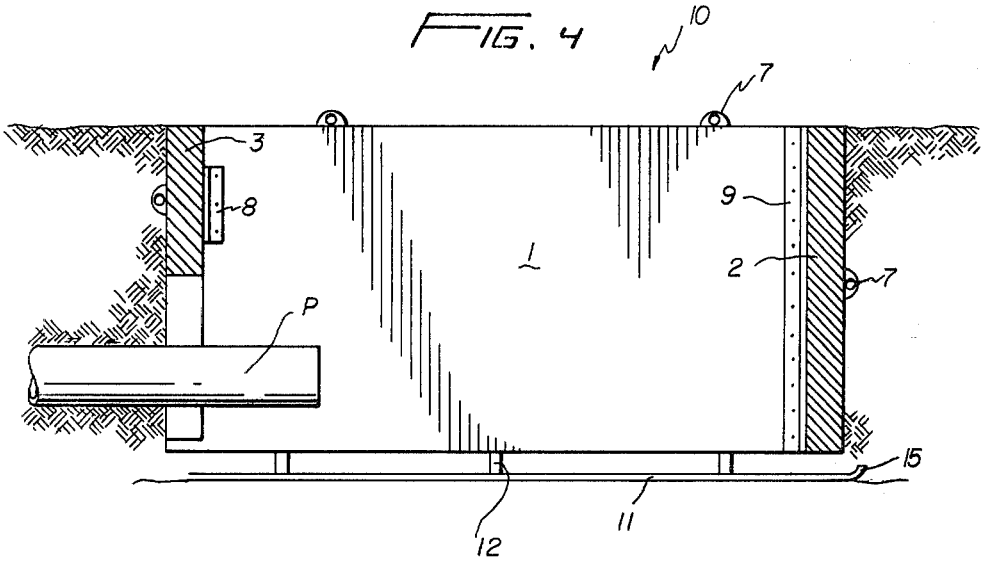
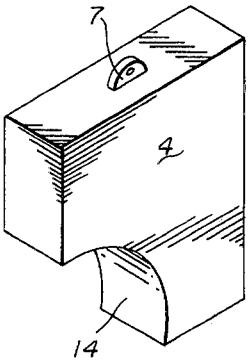
FIG. 5
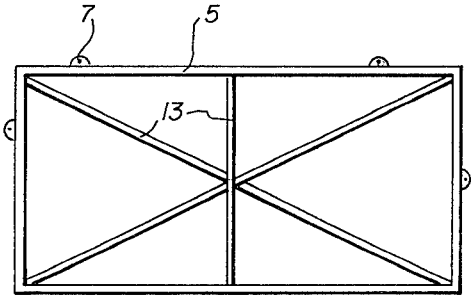
FIG. 6
FIG. 7
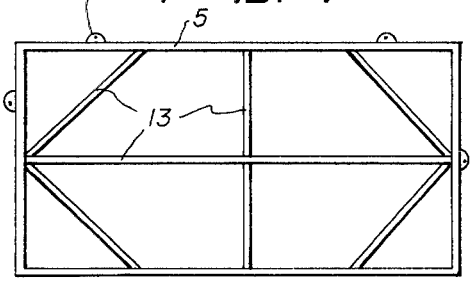
FIG. 8
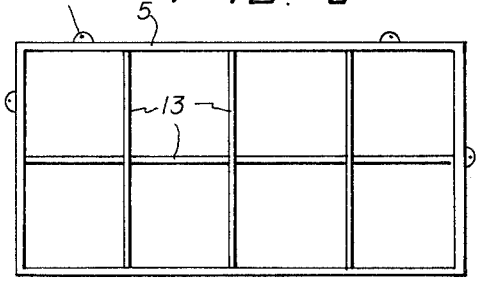

SAFETY TRENCH BOX

BACKGROUND OF THE INVENTION

On a nationwide basis, the incidence of trench cave-ins has been a news item that appears with disturbing regularity. Even with the inclusion of retaining walls and associated supports, the devices according to the prior art are generally difficult to assemble and therefore time consuming in their deployment, or else they are more easily deployed but do not provide adequate protection for the workmen within the environment. Since a common activity when working in trenches is the laying of pipe and the like, heavy hoisting equipment is usually present in order to allow the piping to be inserted within the trench. Prior art devices which appear to most closely approximate the instant invention include the following patents, but do not appear to benefit from the presence of on site hoisting equipment:

U.S. Pat. No. 3,114,244 Silver; U.S. Pat. No. 3,316,721 Heilig;

U.S. Pat. No. 3,254,490, Moore; U.S. Pat. No. 3,869,868 Irsai.

Each of these references teaches the use of a retaining wall support device which cannot be conveniently advanced along the length of the trench as does the instant application, and therefore any similarities between these devices and the instant application are merely coincidental.

SUMMARY OF THE INVENTION

Accordingly, this invention has as an object the provision of a box adapted to fit within the trench and be advanced along the length thereof by means of the hoisting equipment commonly found within the trench working environment.

It is a further object of this invention to provide a device of the character described above which can easily be advanced along the length of the trench and is safe to use.

It is yet a further object of this invention to provide a device of the character described above which can be relatively easily transported from job site to job site and is durable in construction.

It is yet a further object of this invention to provide a device of the charactor described above which can allow the introduction of new work material within the safety confinement boundaries so that the workers may be protected at all times while the work is being advanced therethrough.

These and other objects will be made manifest when considering the following detailed specification when taken in conjunction with the appended drawings.

BRIEF DESCRIPTION OF THE DRAWINGS

FIG. 4 is a sectional view taken along lines 4—4 of FIG. 1.

FIG. 5 is a perspective view of a work introduction area.

FIG. 6 is a view of one of the wall cores showing one bracing variation.

FIG. 7 is a view similar to FIG. 6 showing a second variation of the wall bracing.

FIG. 8 is a third embodiment of the core of one of the side walls.

BRIEF DESCRIPTION OF THE PREFERRED EMBODIMENT

Figure 1:
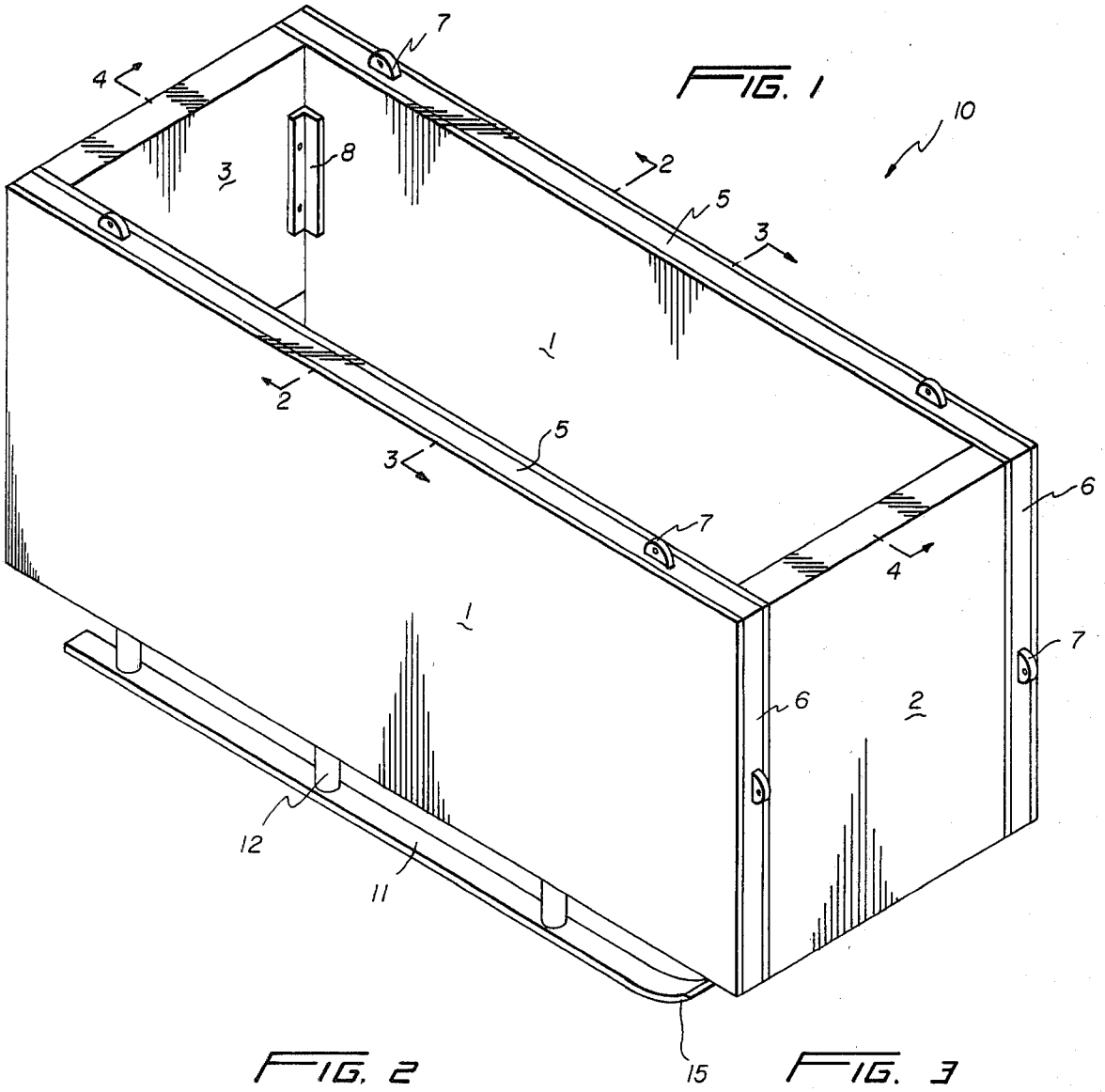
FIG. 1 is a perspective view of the safety device according to the present invention.

Referring to the drawings now, wherein like reference numerals refer to like parts throughout the several drawing figures, reference numeral 10 is directed to the device for protecting workmen from trench cave-ins. This safety trench box 10 is generally formed and defined as a barrier surrounding the perimeter of a work area and ideally has a depth substantially that of the depth of the trench.

The barrier comprises four walls oriented in substantially rectangular configuration wherein the substantially longer side walls 1 are formed of a composite laminate material and the two end walls 2 and 3 are solid. Specifically, the side walls 1 are formed of spaced plate members 1 of preferably sheet metal, having a substantial thickness and disposed between spaced parallel plates 1 there is provided a ribbed core frame 5 wherein a cross bracing support mechanism defined by ribs is disposed.

The core frame 5 is generally a rectangular grid having sides, top and bottom braces, and the ribs within this rectangular framework may be formed in a variety of patterns for additional strength and rigidity. For example, FIG. 6 shows one configuration in which the ribs 13 extend from corners in a diagonal fashion and a further rib 13 is vertically oriented along the intersection of the diagonal braces and terminate along mid-points of the top and bottom frame members 5. FIG. 7 shows a bracing system in which the braces 13 rigidify the corners by providing braces that extend from adjacent sides approximately acting as a chord at the corners, and combined with a cross shaped bracing network that extends between the mid-points of the frame 5 additional bracing is not needed.

FIG. 8 shows a variation in which the core is interbraced by a plurality of vertical braces extending between the top and bottom walls of the frame 5 and at least one horizontal brace connecting the mid-points of the side walls of the frame 5.

Figure 2:
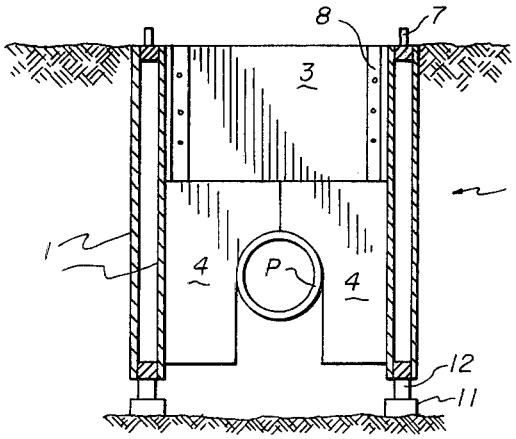
FIG. 2 is a sectional view taken along lines 2—2 of FIG. 1.
Figure 3:
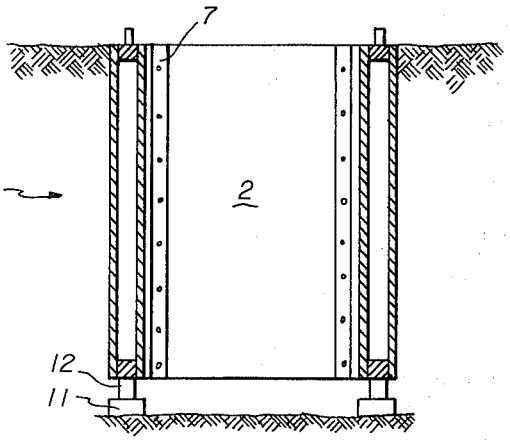
FIG. 3 is a sectional view taken along lines 3—3 of FIG. 1.

The end walls 2 and 3 are made of solid material to assure that deformation is not likely to occur from at unexpected cave-in along the side faces 1 of the trench box, and it is to be noted in viewing FIGS. 2 and 3 that the solid wall 2 extends the entire length of the barrier, whereas the opposed end wall 3 extends only a short distance along the height from the top down. Disposed immediately below this short plate 3 there is provided a pair of symmetrically formed solid steel plates 4 which when taken together form a downwardly extending bifurcation so that work can extend through the opening defined by the area between the bifurcation. As shown in FIG. 5, the opening on each of the plates includes a substantially circular cutaway section which extends thereafter to a substantially vertical wall 14. The plates 4 are connected to the upper end wall 3 by means of pins which extend through ears 7 formed on a top face of the steel plate 4. These pins extend through the upper wall 3 in such a manner that the depending plates 4 are firmly affixed thereto. The end walls 3 and 2 are connected to the side walls 1 by means of angle irons 8 and 9 each having a substantially L-shaped configuration and may be welded to each one of the side walls and pinned to the end wall, or vice-versa.

In order to advance the safety box along the length of trench, the safety device is supported upon and rides on a means to carry the barrier which in a preferred form includes a pair of runners one each of which is affixed to and parallel with the side walls and are provided with feet 12 connecting the runners 11 to the bottom edge of the side wall. The front of the runners have an upwardly turned edge 15 so that obstructions such as rocks, dirt clods and the like can be encountered without seriously affecting the ability of the safety device to be advanced along the length of the trench. In order to assist the runners in moving down the length of the trench, a plurality of eyelets 7 are disposed on the edges of the core frame 5 so that cables can be attached thereto and the entire apparatus can be dragged along the trench. Also, it is possible by using these eyelets to pick up the trench box with a hoisting implement and load it on a vehicle for transport to another job site.

In use and operation therefore it can be seen that a pipe P (FIG. 4) can be payed out along the back wall 3, 4 of the safety device and a new section of pipe disposed within the safety box where workmen can fasten pipe sections together, and as each section of pipe has been attached to a previous section, the trench box can be advanced down the length of the trench in order to receive a further pipe segment without the workers having to fear the possibility of a cave-in, and without the need for advance workers to provide shoring on either side of the trench for the worker's safety.

Having thus described the invention, it should be understood that numerous structural modifications are contemplated as being a part of this invention as set forth herein above and as defined herein below by the claims.

What is claimed is:

1. A device for protecting workmen from trench cave-ins comprising, in combination:

a barrier means surrounding the perimeter of a work area having a depth substantially complemental to the depth of the trench wherein said barrier means includes first and second pairs of spaced parallel imperforate walls, each pair orthogonally offset and interconnected at wall termini so as to form a box having an open top and bottom face, and an opening along a bottom area of said barrier means to allow work to be introduced therethrough wherein said opening is formed on one wall of said first pair which defines end walls and said one wall includes a solid rigid panel upper portion interconnecting wall termini of said second pair and a lower panel formed from two symmetrical half portions removeably depending from said upper panel and together forming a downwardly extending bifurcation defining said opening through which the work passes whereby said device provides open top and bottom areas to allow placement therein of pipes or the like and access to the trench bottom.

2. The device of claim 1 including means to advance and carry said barrier along the length of the trench.

3. The device of claim 2 wherein said second pair of walls comprises a laminate of inner and outer plates within which is interposed a ribbed core frame.

4. The device of claim 3 wherein said means to advance and carry said barrier includes a pair of runners affixed to a bottom edge of said second pair of walls spaced therefrom by feet interposed between said runners and said bottom edges, and plural hook eyelets on remaining edges for advancement of said device by pulling.

5. The device of claim 4 wherein said pairs of walls are interconnected by means of angle irons.

6. The device of claim 5 wherein said ribbed core comprises an outer rectangular cage braced by diagonally disposed ribs and a further rib intersecting said diagonally disposed ribs extending to mid-points of opposed cage sides.

7. The device of claim 5 wherein said ribbed core comprises an outer rectangular cage braced by one horizontal rib connecting opposed midpoints of said cage sides and plural transverse vertical ribs connecting other cage sides.

8. The device of claim 5 wherein said ribbed core comprises an outer rectangular cage braced cross shaped ribs interconnecting cage sides and further braces spanning corners on an interior portion of said cage.

* * * * *